US008523050B1

(12) United States Patent
Andreozzi

(10) Patent No.: US 8,523,050 B1
(45) **Date of Patent: *Sep. 3, 2013**

(54) SYSTEM AND METHOD FOR COLLECTING CONTAINERS

(76) Inventor: William F. Andreozzi, Greenville, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/589,391

(22) Filed: Aug. 20, 2012

Related U.S. Application Data

(63) Continuation-in-part of application No. 13/070,525, filed on Mar. 24, 2011, now Pat. No. 8,276,807.

(60) Provisional application No. 61/320,013, filed on Apr. 1, 2010.

(51) Int. Cl.
*A47G 29/12* (2006.01)

(52) U.S. Cl.
USPC ... 232/43.3; 232/43.2; 220/908.1; 340/568.1; 235/379

(58) Field of Classification Search
USPC ..... 232/44, 43.2, 43.3, 47, 30–32, 43.1; 312/211; 220/908, 908.1, 908.3, 495.06, 220/495.08; 340/545.6, 568.1, 572.1, 572.4; 235/379
See application file for complete search history.

(56) References Cited

U.S. PATENT DOCUMENTS

| | | | | |
|---|---|---|---|---|
| 4,609,122 | A | | 9/1986 | Ziegenbein |
| 4,894,717 | A | * | 1/1990 | Komei ..... 348/150 |
| 5,137,212 | A | | 8/1992 | Fiterman et al. |
| 5,148,975 | A | | 9/1992 | Dickerson et al. |
| 5,223,829 | A | * | 6/1993 | Watabe ..... 340/5.73 |
| 5,386,462 | A | * | 1/1995 | Schlamp ..... 379/93.12 |
| 5,517,907 | A | | 5/1996 | Fox |
| 5,588,358 | A | | 12/1996 | Klepacki et al. |
| 5,667,136 | A | | 9/1997 | Chen |
| 5,884,556 | A | | 3/1999 | Klepacki et al. |
| 6,715,669 | B2 | | 4/2004 | Hara |
| 6,772,903 | B1 | | 8/2004 | Riggins et al. |
| 6,928,422 | B2 | | 8/2005 | Sansone |
| 7,175,070 | B1 | | 2/2007 | Brisport et al. |

* cited by examiner

*Primary Examiner* — Wiliam L. Miller
(74) *Attorney, Agent, or Firm* — Salter & Michaelson

(57) ABSTRACT

An apparatus is illustrated for collecting containers and that includes a storage receptacle having an access door and a support tray. The storage receptacle has an opening through which a container is inserted for receipt on the support tray. The support tray has an initial substantially horizontal position. A scanner detects the presence of the container on the support tray. A collection bag is supported in the storage receptacle at a bottom thereof and for receiving a plurality of containers. The collection bag is accessible via the access door. A mechanism is responsive to the scanner detecting the presence of the container for releasing the container from the support tray to enable the container to fall into the collection bag. The container is released by the support tray pivoting from the substantially horizontal position to an angled position to thus enable the container to fall into the collection bag.

20 Claims, 6 Drawing Sheets

SYSTEM AND METHOD FOR COLLECTING CONTAINERS

RELATED APPLICATION

This application is a continuation-in-part (CIP) of U.S. Ser. No. 13/070,525, now U.S. Pat. No. 8,276,807, which was filed on Mar. 24, 2011 and priority for that application is hereby claimed under 35 U.S.C. §119(e) to U.S. Provisional Patent Application No. 61/320,013 which was filed on Apr. 1, 2010 and each of which is incorporated by reference herein in its entirety.

FIELD OF THE INVENTION

The present invention relates in general to a collection system for containers. More particularly, the invention pertains to a system, apparatus and method that includes a storage receptacle where reusable containers can be deposited and credit provided for the depositing of the container.

BACKGROUND OF THE INVENTION

In school cafeterias, as well as in other similar establishments, there is a substantial use of throw away containers such as the typical styrofoam container for food. This is wasteful in that these containers are usually disposed of and end up in landfills or the like sites.

Accordingly, it is an object of the present invention to provide an improved system and apparatus for collecting containers, particularly reusable containers.

Another object of the present invention is to provide a system for collecting containers wherein each container is identified by a code that is scanned as the container is inserted into the storage receptacle.

Still another object of the present invention is to provide a system, apparatus and method for collecting containers and in which a token or receipt is generated upon the deposition of the container.

SUMMARY OF THE INVENTION

To accomplish the foregoing and other objects, features and advantages of the present invention there is provided a system for collecting containers, comprising: a storage receptacle having an access door; a support tray; the storage receptacle having a front panel slot through which a container is inserted for receipt on said support tray; a scanner for detecting the presence of the container on the support tray; a collection bag supported in the storage receptacle at a bottom thereof and for receiving a plurality of containers; and a mechanism responsive to the scanner detecting the presence of the container for releasing the container from the support tray to enable the container to fall into the collection bag.

In accordance with other aspects of the present invention the collection bag is supported at the bottom of the storage receptacle in an open position for ready receipt of the containers; the collection bag is a plastic bag that is clipped into position at the bottom of the receptacle, and, when removed, is closed; the scanner is disposed over the support tray so as to be in position to scan the container, said container having a code thereon that is scanned; the mechanism for releasing the container includes a pivot mechanism that pivots the support tray so that the container is released and allowed to fall to the collection bag; the pivot mechanism is disposed at the front of the receptacle and the front of the support tray; including a token hopper and associated token slot, a token being dispensed once the container is released; including a trigger device disposed in the path of a falling container for controlling the dispensing of the token; including an electrical controller for receiving a detection signal from the scanner; and wherein the mechanism for releasing the container includes a pivot mechanism that pivots the support tray, and the electrical controller, upon receiving the detection signal, actuates the pivot mechanism so that the container is released and allowed to fall to the collection bag; including a card reader and associated card, said card reader, upon reading the card, crediting the card holder for the deposited container.

In accordance with another embodiment of the present invention there is provided a method of collecting containers in a collection bag that is disposed in a storage receptacle, comprising the steps of: inserting a container through an opening in the storage receptacle by placing the container on a support tray; scanning the container to detect the presence of the container on the support tray; and, upon detection of the container, releasing the container from the support tray to enable the container to fall into the collection bag.

Further aspects of the method of the present invention include resting the collection bag at the bottom of the storage receptacle in an open position for ready receipt of the containers; wherein the releasing step includes providing a pivot mechanism that pivots the support tray so that the container is released and allowed to fall to the collection bag; providing a token hopper and associated token slot, a token being dispensed once the container is released; providing a trigger device disposed in the path of a falling container for controlling the dispensing of the token; and dispensing the token through a token slot in the storage receptacle.

In another embodiment of the present invention there is provided an apparatus for collecting containers, comprising: a storage receptacle having an access door; a support tray; said storage receptacle having an opening through which a container is inserted for receipt on said support tray; said support tray having an initial substantially horizontal position; a scanner for detecting the presence of the container on the support tray; a collection bag supported in the storage receptacle at a bottom thereof and for receiving a plurality of containers; said collection bag being accessible via said access door; and a mechanism responsive to the scanner detecting the presence of the container for releasing the container from the support tray to enable the container to fall into the collection bag; said container being released by the support tray pivoting from the substantially horizontal position to an angled position to thus enable the container to fall into the collection bag.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 2:
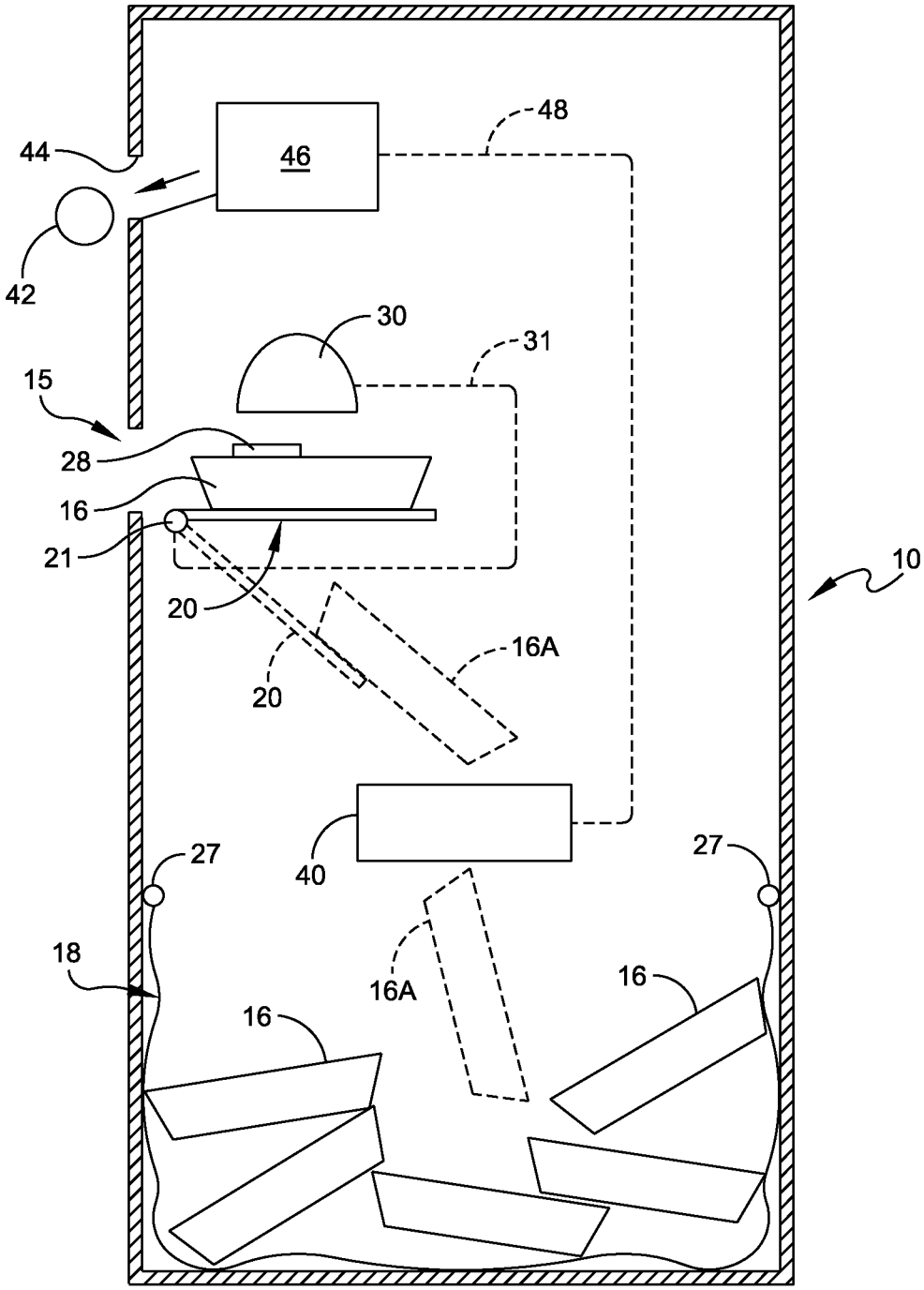
FIG. 2 is a schematic diagram showing further details internally of the storage receptacle and illustrating the principles of the present invention.

The present invention provides a system, apparatus and method by which reusable container can be used for food with each of these containers being identified by a code provided on the container such as a bar code. A container 16 is illustrated in the drawings. This is typically a plastic container. For a reusable container, this is typically constructed of a hard plastic material and may be considered as of conventional type. When the food in the container is purchased, there is a separate charge for the container but that charge is then reimbursable once the container is returned by being deposited into the storage receptacle 10. In accordance with the present invention, the deposited containers 16 are accumulated in a collection bag 18, such as illustrated in FIG. 2 where the containers 16 are temporarily stored. Each of the containers 16 preferably is provided on at least its top surface with a bar code that identifies the container. A bar code may be provided on both the top and bottom surfaces of the container 16. Also, in one embodiment in accordance with the invention, there is provided a token hopper and associated output token slot. In accordance with another version of the present invention, the storage receptacle is provided with a card reader that identifies the purchaser. Once the card is read and the returned container has been scanned, then a credit can be applied to the card or a separate printed out receipt may be provided.

Figure 1:
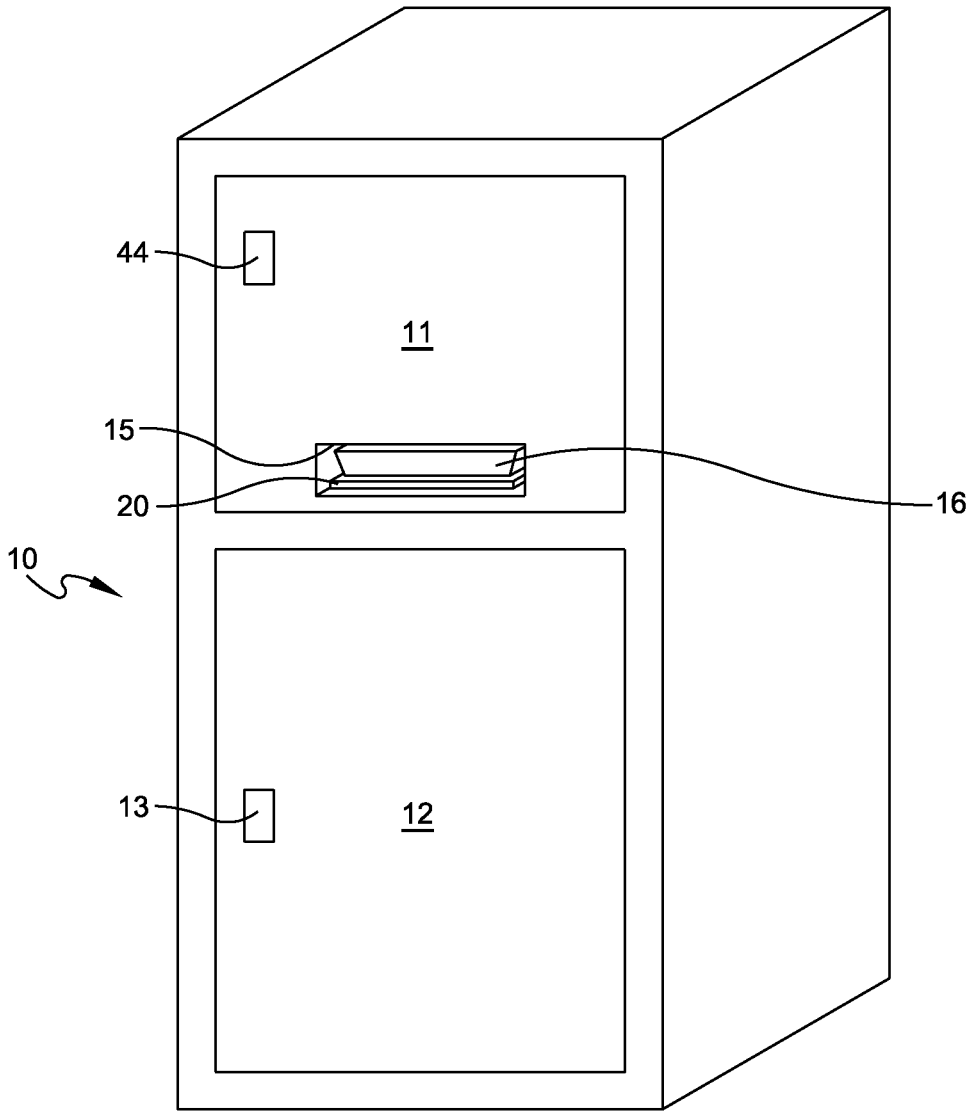
FIG. 1 is a schematic diagram of one simplified version of a storage receptacle for the system and apparatus of the present invention.

Reference is now made to the drawings and in particular to FIGS. 1 and 2 for further details of the storage receptacle 10. The storage receptacle 10 may be constructed of metal and may be approximately 5 to 6 feet tall. The cross-sectional size of the container may be 36 inches wide by 30 inches deep. As noted, in particular, in FIG. 1 the storage receptacle 10 is provided with an access door 12 that is preferably provided with some type of a handle 13 and preferably also some type of a lock arrangement so that access is only provided by an authorized person. It is inside of the door 12 that the collection bag 18 is arranged. Although the door 12 is shown at the front of the storage receptacle, it is understood that the door could also be provided at other locations about the storage receptacle as long as access is provided to the collection bag.

FIG. 1 also illustrates a top door or panel 11 having an opening or slot 15 through which the container 16 may be inserted. See also the schematic diagram of FIG. 2 and the position of the opening or slot 15.

In an alternate embodiment of the present invention, at the opening 15 there may be provided a drawer that can be slid and out and into which the container 16 is deposited. In the diagram of FIG. 2, the container 16 simply rests upon the support tray 20. In either the case of a draw that is slid in and out, or the use of a support tray 20, it is noted that once the scanner 30 detects the presence of the container 16, the container is then released from either the draw or the support tray to enable the container to fall into the collection bag. In this regard, there is provided a mechanism that is responsive to the scanner detecting the presence signal for releasing the container. In the case of the use of a drawer (not shown), there may be a pivot point on the drawer that enables the drawer to eventually pivot. In either case, the support member for the container may have an initial substantially horizontal position, as illustrated in FIG. 2, and when released, there is a pivoting action from the substantially horizontal position to an angled position to thus enable the container to fall into the collection bag 18. In FIG. 2 the support tray 20 is shown in solid outline in its horizontal position and furthermore is shown in dotted outline in its angled position. In FIG. 2 the aforementioned mechanism is illustrated by a pivot mechanism 21 that may be spring-biased toward its horizontal position but when engaged, swings the support tray 20 to its angled position to allow the container to fall toward the collection bag 18.

In an alternate embodiment a conveyor belt may also be used either in place of the tilting tray or by conveying the container to the tilting tray. Another alternate embodiment would be wherein containers could be inserted from opposite locations of the housing thus requiring separate support trays. In still another embodiment of the invention, more than one plastic bag may be used for capturing containers.

The schematic diagram of FIG. 2 also illustrates the collection bag 18 which is preferably a plastic bag that is used to collect the container 16. There is illustrated in FIG. 2 oppositely disposed clips 27 that may be arranged on inside walls of the storage receptacle 10 on opposite sides of the collection bag and below the support tray 20. The plastic bag 18 in FIG. 2 is illustrated as accumulating a plurality of these reusable containers 16 as they fall from the support tray 20. As indicated previously and in connection with FIG. 1 herein, the door 12 is primarily used to provide access to inside the storage receptacle 10 so that the plastic bag 18 can be withdrawn along with the containers 16 that are disposed therein. For this purpose, the clips 27 may be released and the plastic bag 18 may then be closed for removal thereof from the storage receptacle.

The opening 15 is preferably provided at a convenient height from the bottom of the storage receptacle 10. For example, the opening 15 may be disposed about 48 inches from the bottom of the storage receptacle at a convenient location for use by students or other people that are returning the reusable containers. When a drawer is used, the part thereof that is inside of the storage receptacle forms a trapdoor bottom that essentially hinges so as to move to an angled position similar to the angled position illustrated in FIG. 2. If a drawer is used, it is fully opened so as to receive a reusable container and as the drawer is moved inward the trapdoor pivots and releases the container into the collection bag.

Each of the containers 16 are preferably relatively hard plastic reusable containers that are comprised mainly of a top section and a bottom section that hinge relative to each other. This enables the food product to be placed inside the container and it is even possible to be eaten directly from the container. Each of these containers 16 include a bar code 28 that may be disposed only on the top of the container or on both top and bottom sides of the container. Because it is possible that each container may be inserted in either direction, it is preferable that the container have a bar code on both the top and bottom sides thereof. FIG. 2 also illustrates a bar code scanner 30 that is appropriately supported within the storage receptacle 10. The scanner 30 is supported in a fixed position and directed toward the support tray 20. The bar code scanner can be supported in any number of different weighs and is positioned so that as each of the containers is inserted onto the support tray 20, the code on the container is read.

Once the code is read, then a signal is directed from the scanner 30 to the pivot mechanism 21 for releasing the support tray 20, enabling the support tray to transition to its angled position as illustrated in dotted outline in FIG. 2. With reference to FIG. 2, note the dotted connection line 31 indicating a signal from the scanner 30 coupled to the pivot mechanism 21. FIG. 2 also illustrates the container in dotted outline at 16A in a position of falling from the support tray 20 to the collection bag 18. FIG. 2 also illustrates a series of containers 16 that have been previously transitioned into the collection bag 18.

Also illustrated in FIG. 2 is a trigger device 40. This is positioned in the path of the container as it falls from the support tray 20 to the collection bag 18. The trigger device 40 is preferably fixed in position and may include a trigger arm that is activated by contact with the container 16. Upon activation of the trigger device 40, a token 42 is dispensed through the slot 44 from the token hopper 46. FIG. 2 also illustrates a dotted line 48 coupling from the trigger device 40 to the token hopper 46. This dotted line is representative of a signal initiated at the trigger device 40 to cause a token to be dispensed from the token hopper 46. Herein, the description relates to a "token." However, a receipt could also be printed in which case, in place of the token hopper 46 there may be provided some type of a printing device to output a printed slip in place of the token 42. The printed slip can then be used as a credit.

Figure 3:
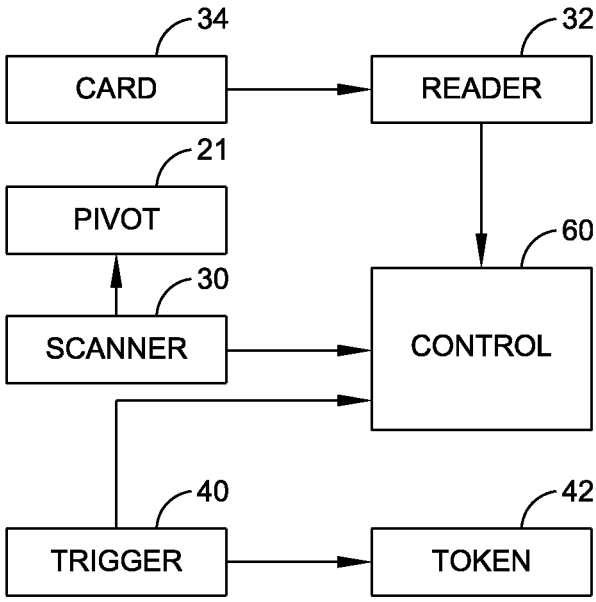
FIG. 3 is a simplified block diagram illustrative of the principles of the present invention.

In an alternate embodiment of the present invention that is considered in the block diagram of FIG. 3, and essentially in place of the trigger device and token hopper, there may be provided a card reader 32. Also, as described hereinafter in FIGS. 5 and 6, the system may accommodate both the dispensing of a token as well as credit on a read card. With further regard to FIG. 3, the card reader 32 is considered as a conventional device that is used for reading the information on the card 34. From a structural standpoint, the card reader 32 is preferably disposed at a convenient location close to or above the opening 15 in a position that is readily accessible by the user. FIG. 3 also illustrates a card 34 that is to be read by the card reader 32. Items that are disclosed herein such as the scanner 30 and the card reader 32 are considered to be conventional devices. The card 34 itself is one that could be a student identification card and thus the information associated therewith is basically information relating to the holder of the card.

When an item is purchased by the student, the card 34 is used for the purchase. At the same time, a charge is made for the to-go box 16 that is indicated as an additional debt on the card 34. At the same time, a charge is made for the reusable container 16 that is indicated as an additional debt on the card 34. The purpose of the storage receptacle 10 of the present invention is to collect reusable containers 16 in a convenient manner. The person that has then deposited the container is credited for the return of the container. In the primary embodiment disclosed herein, this crediting to the user is by virtue of issuing a token 42. The storage receptacle 10 is a stand alone unit that can be placed anywhere and does not need to necessarily be visible to the dining staff. It only needs to be emptied on some type of a regular time schedule. To empty the storage receptacle, the door 12 is opened and the plastic bag 18 is removed. A new plastic bag 18 is then inserted with it being secured by the clips 27 so as to be held in place in an open condition for receiving further containers. One of the advantages of the system of the present invention is that all of the containers are reusable and this can save substantial amounts of money in connection with the previous use of discardable styrofoam type containers, The following is a description of the procedures used in connection with the system and apparatus of the present invention. Thus, one aspect of the present invention is a method of collecting containers in a collection bag that is disposed in a storage receptacle. The student receives the food product in a reusable container and, as mentioned previously, this container has a bard code on at least one surface thereof. The cafeteria or other food distribution facility has the option to set the selling price of the reusable container. At the time of purchase, the user will be charged for the container as well as the contents thereof with the container being listed as a separate charge. The container purchase remains in the data base as a purchase and, in the case of the embodiment that employs a card reader, the price of the container is recorded.

When the student is to return the reusable container, the container is inserted through an opening in the storage receptacle and placed on the support tray. In accordance with the method of the present invention, the next step is that of scanning the container to detect the presence of the container n the support tray. This is followed by, upon detection of the container, releasing the container from the support tray to enable the container to fall into the collection bag. An associated step of the method includes providing a trigger device disposed in the path of a falling container for controlling the dispensing of a token. This is dispensed through a token slot in the storage receptacle. This token represents the credit that can be later used by the user of the system.

In the alternate embodiment of the present invention wherein a card reader is used, when the student wants to return the container, the student swipes the meal card at the card reader 32 and places the reusable container on the support tray. The bar code is read by the scanner and the student is then credited with the purchase price of the reusable container. The database only allows for an equal amount of returns to purchases. No one can get credit for more than they purchased which deters from stealing other containers and getting credit on their account.

Figure 4:
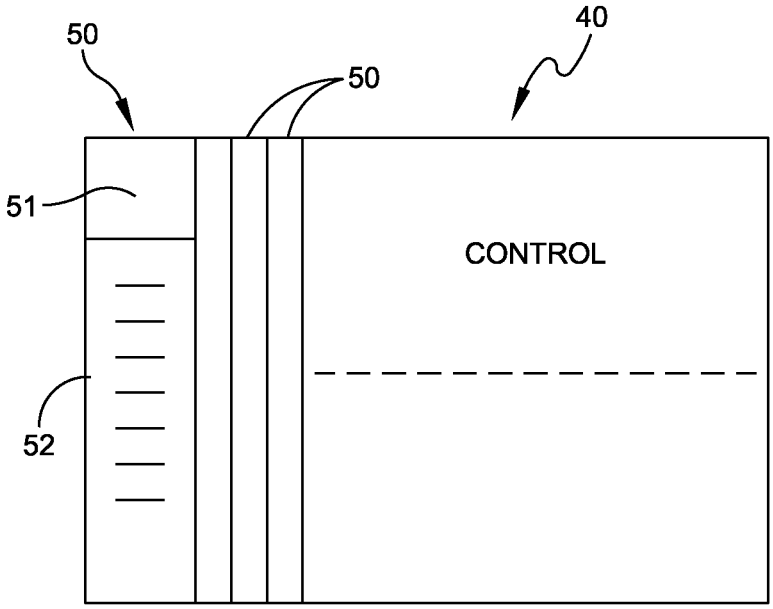
FIG. 4 is a diagram illustrating the data field associated with the electrical controller.

Reference is now made to FIGS. 3 and 4. These are simple diagrams illustrating that the scanner 30 and reader 32 would connect to some type of electrical controller 60. FIG. 4 depicts a data field having columns 50 that can represent different users. Within each field 50, it is noted that there is a field 51 for the card code and then a series of fields 52 that represent the containers. Thus, in an example, when a purchase is made, the cost of the container 16 is added and would be shown in field 52 for a predetermined card holder. This is a part of the electrical controller 60. When the container 16 is returned, then this is read by the scanner 30 and a credit would be provided in field 52 to indicate that the previous charge for the box 16 is essentially deleted. Should the student take more than container, then as each is scanned, it would be considered as a returned container. Because the student's card is read at approximately the same time that the container are deposited, the system can readily determine the association between the student and the returned container.

Also, in accordance with the present invention, when the initial purchase occurs, the bar code can be read on the container 16 at that time along with the students ID code. Thus, when the box or boxes are returned, the electrical controller 60 can relatively easily determine whether the returned container or containers correspond with the code read at the card reader 32. This makes for a relatively foolproof system as far as giving a credit back to students for purchased containers 16.

Figure 5:
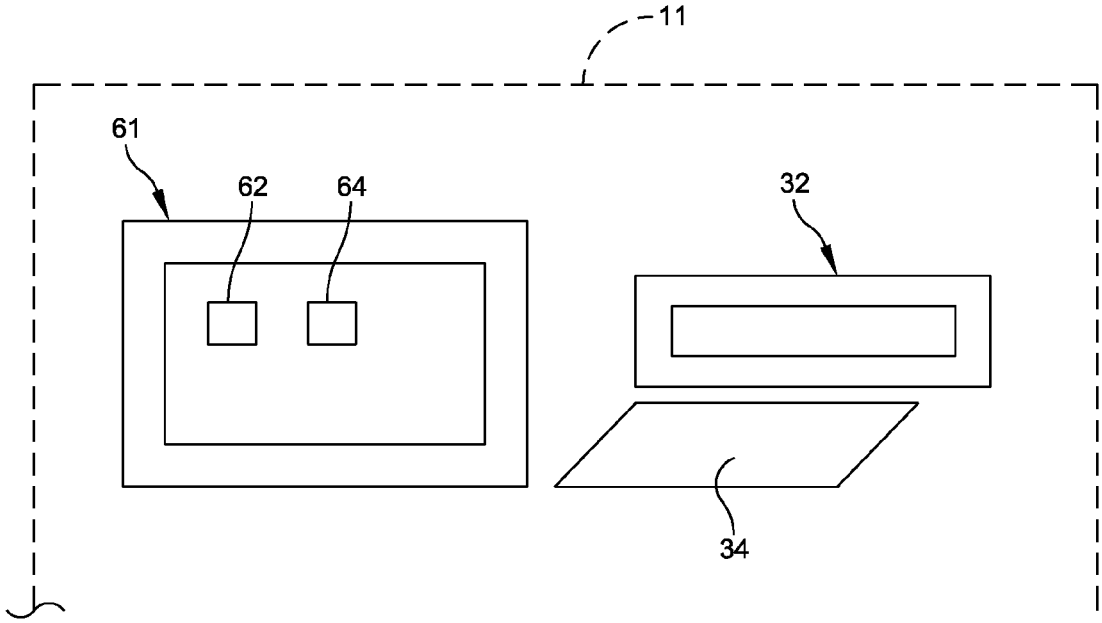
FIG. 5 illustrates a further embodiment of the present invention by schematically depicting a portion of the door panel 11 mounting a touch screen and card reader.

Reference is now made to FIG. 5 which shows an alternate embodiment that incorporates at the front of the machine at the panel 11, a touch screen 61. Shown adjacent to the touch screen 61 is a card reader slot at 32, also depicting the student ID card 34 that may be read by the conventional reader.

Figure 6:
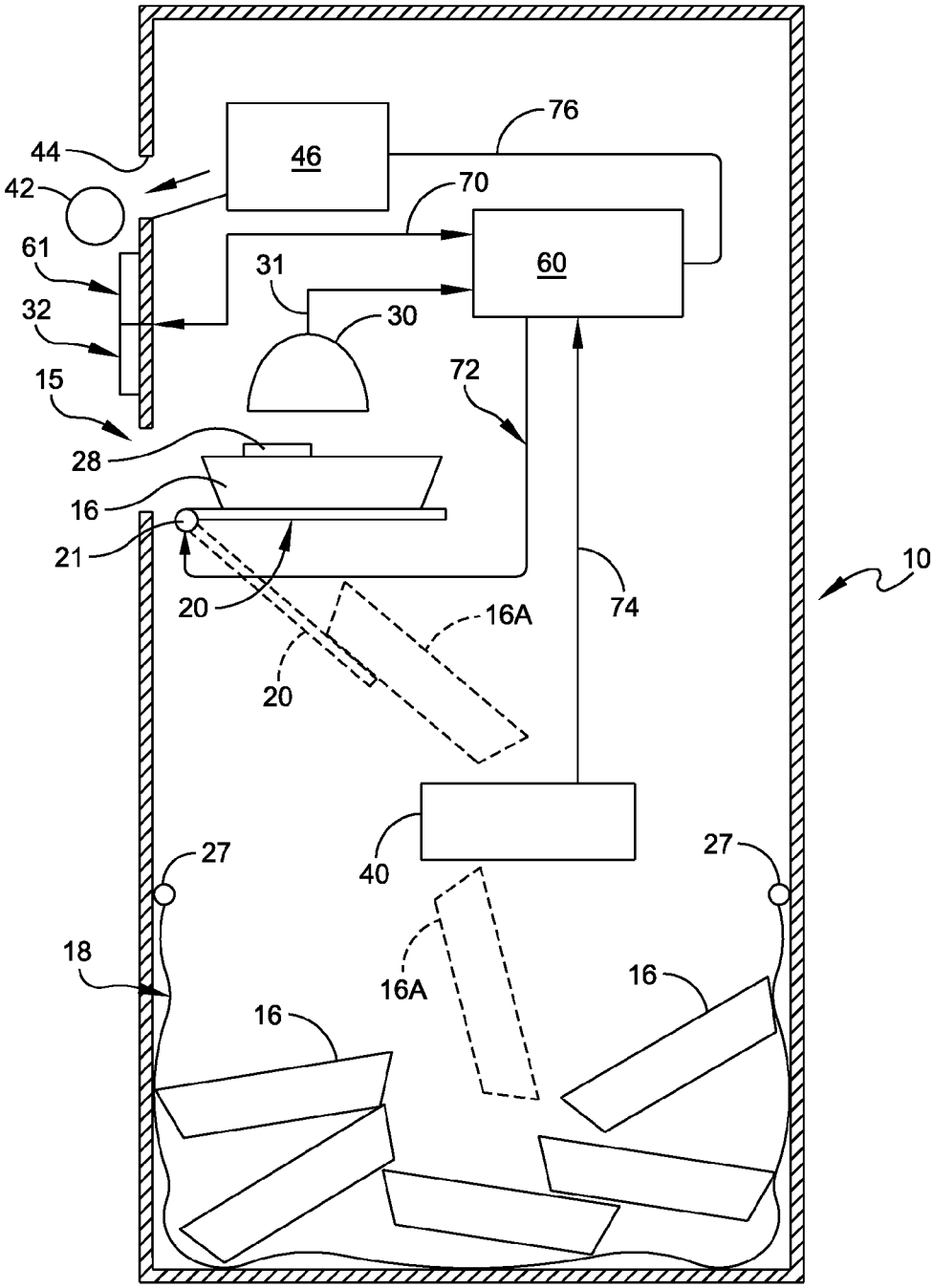
FIG. 6 is a further schematic representation with like components as illustrated in FIG. 2 but incorporating both token dispensement and card reader acknowledgment.

In connection with FIG. 1, the touch screen 61 may be positioned approximately in the middle of the panel. This touch screen 61 is used for providing instructions in connection with either dispensing a token or providing a credit on the student identification card. In this connection, reference is now also made to the alternate embodiment shown in FIG. 6 wherein the touch screen 61 and the card reader 32 are schematically depicted at the front of the apparatus. FIG. 6 also depicts the scanner 30 that is reading the bar code 28 as in the previous embodiments. FIG. 5 also schematically depicts two icons or buttons 62 and 64. These icons are only illuminated after the scanner 30 has detected that the appropriate bar code has been read. The icon 62 may display "dispense token." The icon 64 may display "swipe ID card." The user then selects either of the touch sensitive icons 62 or 64.

In the diagram of FIG. 6 it is noted that a line 70 interconnects the electronics 60 with the both the touch screen 61 and the card reader 32. Initially, depending upon which of the buttons 62 or 64 is selected, via line 70, this provides an instruction to the electronics 60 to take further action. Prior to making the button selection, the tray 20 remains in its position shown in solid outline in FIG. 6, not yet released to the collection bag.

If either of the buttons 62 or 64 is selected, and if the bar code has been read at scanner 30, (via line 31) then an output signal on line 72 couples to the support tray for activating or pivoting the support tray so as to release the container 16 to fall into the collection bag. The released container is shown at 16A in FIG. 6.

This embodiment illustrated in FIG. 6 also includes the motion sensor 40. The motion sensor 40 has also previously been described as a trigger device. In either instance, the device 40 detects the passage of the container into the collection bag and provides a signal on line 74 to the electrical controller 60. By the detection of the container falling into the collection bag, one can be assured that the container has entered the collection bag and thus at that point in time the control electronic 60, depending upon which of the buttons 62 and 64 were selected, can either dispense a token or provide a credit on the identified ID card of the student. In FIG. 6, the line 76 from the electronic controller 60 couples to the token hopper 46 to enable release of a token 42 therefrom. Also, and as previously described in connection with FIGS. 3 and 4, a credit can be provided directly to the student's account. This credit is provided electronically.

Figure 7:
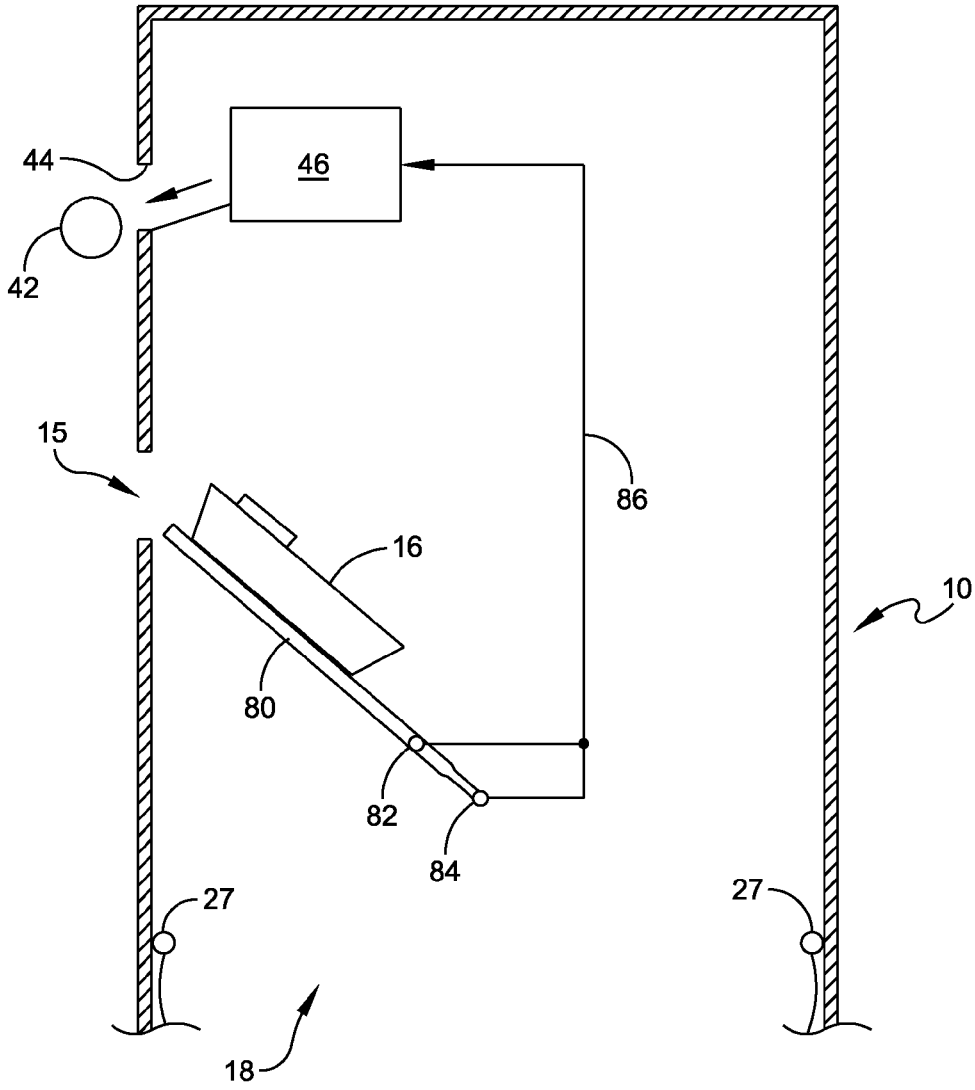
FIG. 7 is a schematic diagram of another embodiment of the present invention which is a more simplified embodiment that involves dispensing tokens based upon the container passing a predetermined point on a chute.

FIG. 7 illustrates still another embodiment of the present invention. This embodiment is more simplified in that it is meant to simply dispense tokens 42 from a token hopper 46 and without requiring any extensive electronic controls. In this particular embodiment, there is illustrated a chute 80 that the container 16 is rested upon. The user simply places the container through the opening 15 onto the chute 80 where the chute 80 is preferably disposed at an angular position so that the tray will essentially immediately descend toward the collection bag 18. In this embodiment there are a pair of motion or position sensors 82 and 84 that are spaced apart by a predetermined distance. Both of these detectors connect by way of a line 86 to the token hopper 46 for controlling the dispensing of tokens. If the container passes only the trigger device or sensor 82 then this is not a sufficient condition for dispensing the token. However, once the container has passed both sensors 82 and 84, the signal on line 86 indicates that a token can then be dispensed from the token hopper 46.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A system for collecting containers, comprising:

a storage receptacle having an access door;

a support tray;

said storage receptacle having a front panel slot through which a container is inserted for receipt on said support tray;

a scanner for detecting the presence of the container on the support tray;

a controller responsive to a detection at the scanner;

a collection bag supported in the storage receptacle at a bottom thereof and for receiving the container;

and a mechanism responsive to the controller for detecting the presence of the container for releasing the container from the support tray to enable the container to fall into the collection bag;

wherein the scanner is disposed over the support tray so as to be in position to scan the container, said container having a code thereon that is scanned.

2. The system of claim 1 wherein the collection bag is a plastic bag that is clipped into position at the bottom of the receptacle, and, when removed, is closed.

3. The system of claim 1 wherein the mechanism for releasing the container includes a pivot mechanism that pivots the support tray so that the container is released and allowed to fall to the collection bag.

4. The system of claim 3 wherein the pivot mechanism is disposed at the front of the receptacle and the front of the support tray.

5. A system for collecting containers, comprising:

a storage receptacle having an access door;

a support tray;

said storage receptacle having a front panel slot through which a container is inserted for receipt on said support tray;

a scanner for detecting the presence of the container on the support tray;

a controller responsive to a detection at the scanner;

a collection bag supported in the storage receptacle at a bottom thereof and for receiving the container;

and a mechanism responsive to the controller for detecting the presence of the container for releasing the container from the support tray to enable the container to fall into the collection bag;

a token hopper for releasing tokens and a card reader.

6. The system of claim 5 wherein the collection bag is supported at the bottom of the storage receptacle in an open position for ready receipt of the containers.

7. The system of claim 5 including a touch screen accessible to the user at a panel of the storage receptacle.

8. The system of claim 7 wherein the touch screen has a first icon displayed and concurrently a second icon displayed when the scanner detects the container.

9. The system of claim 8 further including a motion device for detecting that the container has fallen toward the collection bag for one of dispensing the tokens and crediting an ID card.

10. The system of claim 5 including an associated card, said card reader, upon reading the card, crediting the card holder for the deposited container.

11. A method of collecting containers in a collection bag that is disposed in a storage receptacle, comprising the steps of:

inserting a container through an opening in the storage receptacle by placing the container on a support tray;

scanning the container by means of a scanner to detect, by means of a controller, the presence of the container on the support tray;

and, upon detection of the container, releasing the container by means of a release member from the support tray to enable the container to fall into the collection bag;

resting the collection bag at the bottom of the storage receptacle in an open position for ready receipt of the container;

wherein the releasing step includes providing a pivot mechanism that pivots the support tray so that the container is released and allowed to fall to the collection bag.

12. A method of collecting containers in a collection bag that is disposed in a storage receptacle, comprising the steps of:

inserting a container through an opening in the storage receptacle by placing the container on a support tray;

scanning the container by means of a scanner to detect, by means of a controller, the presence of the container on the support tray;

and, upon detection of the container, releasing the container by means of a release member from the support tray to enable the container to fall into the collection bag;

and providing a token hopper and a card reader and a trigger device, the trigger device controlling the controller so as to provide one of dispensing of a token and crediting a user ID card.

13. The method of claim 12 including resting the collection bag at the bottom of the storage receptacle in an open position for ready receipt of the container.

14. The method of claim 12 including providing a touch screen and on the touch screen first and second icons representative respectively of dispensing of the token and crediting the user ID card.

15. The method of claim 14 including only dispensing the token or providing the credit once the trigger device has been activated.

16. A system for collecting containers, comprising:

a storage receptacle having an access door;

a support member;

said storage receptacle having a front panel slot through which a container is inserted for receipt on said support member;

said support member including a chute for receiving the container;

a storage bag in the bottom of the receptacle;

at least a first trigger mechanism for sensing the passing of the container to the storage bag;

a token hopper activated upon detection of the container by said trigger mechanism;

and a control line coupling from the trigger mechanism to the token hopper for controlling the dispensing of a token from the token hopper.

17. The system of claim 16 including a touch screen having at least one icon button that is selectable to dispense the token.

18. The system of claim 17 including a second icon button selectable for swiping an ID card.

19. A system for collecting containers, comprising:

a storage receptacle having an access door;

a support member;

said storage receptacle having a front panel slot through which a container is inserted for receipt on said support member;

said support member including a chute for receiving the container;

a pair of trigger mechanisms for sensing the passing of the container;

and a token hopper activated upon detection by said trigger mechanisms;

said pair of trigger mechanisms being spaced apart.

20. The system of claim 19 wherein each trigger mechanism comprises a sensor and wherein the token hopper is only enabled once both sensors have been activated.

* * * * *